US011566774B2

(12) United States Patent
Merriam et al.

(10) Patent No.: US 11,566,774 B2
(45) Date of Patent: Jan. 31, 2023

(54) LED LUMINAIRE ASSEMBLY WITH UPLIGHT AND SIDELIGHT LENS

(71) Applicant: EATON INTELLIGENT POWER LIMITED, Dublin (IE)

(72) Inventors: Virginia Merriam, Clay, NY (US); Sachin Nimbargi, Maharashtra (IN); Pawan Kumar Yadav, Bihar (IN); Sachin Bhimrao Ahirrao, Maharashtra (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/547,448

(22) Filed: Dec. 10, 2021

(65) Prior Publication Data

US 2022/0186908 A1 Jun. 16, 2022

Related U.S. Application Data

(60) Provisional application No. 63/124,342, filed on Dec. 11, 2020.

(51) Int. Cl.

| | |
|---|---|
| ***F21V 5/00*** | (2018.01) |
| ***F21V 5/04*** | (2006.01) |
| ***F21V 29/76*** | (2015.01) |
| ***F21V 5/02*** | (2006.01) |
| *F21Y 115/10* | (2016.01) |

(52) U.S. Cl.

CPC ..... *F21V 5/045* (2013.01); *F21V 5/02* (2013.01); *F21V 29/763* (2015.01); *F21Y 2115/10* (2016.08)

(58) Field of Classification Search

CPC . F21V 5/002; F21V 3/02; F21V 3/049; F21V 3/0625

See application file for complete search history.

(56) References Cited

U.S. PATENT DOCUMENTS

| | | | | |
|---|---|---|---|---|
| 538,193 | A * | 4/1895 | Frédureau | F21V 29/506 362/340 |
| 1,399,973 | A * | 12/1921 | Limpert | F21S 41/28 362/329 |
| 4,371,916 | A * | 2/1983 | De Martino | F21S 43/26 362/337 |
| 5,416,684 | A * | 5/1995 | Pearce | F21V 5/00 362/310 |
| 5,821,695 | A * | 10/1998 | Vilanilam | F21V 21/043 315/71 |
| 6,425,678 | B1 * | 7/2002 | Verdes | H05B 45/30 362/240 |
| 8,147,099 | B2 | 4/2012 | Thornton | |
| 9,057,493 | B2 | 6/2015 | Simon et al. | |
| 9,228,713 | B2 * | 1/2016 | Skertich, Jr. | F21V 19/003 |
| 10,072,817 | B2 * | 9/2018 | Sergenese | H05K 3/341 |

(Continued)

*Primary Examiner* — Ismael Negron

(74) *Attorney, Agent, or Firm* — Baker Botts L.L.P.

(57) ABSTRACT

A luminaire assembly includes an LED assembly and a lens coupled to the LED assembly. The lens includes a side wall forming an opening sized to receive at least part of the LED assembly and a bottom opposite the opening and coupled to the side wall. The side wall further includes one or more prisms positioned proximate the bottom and configured to direct the light emitted from the LED assembly away from the bottom.

20 Claims, 10 Drawing Sheets
(1 of 10 Drawing Sheet(s) Filed in Color)

(56) References Cited

U.S. PATENT DOCUMENTS

| | | | | |
|---|---|---|---|---|
| 10,100,988 | B2 | 10/2018 | Rodgers et al. | |
| 10,151,444 | B1 * | 12/2018 | Tsai | F21V 7/05 |
| 10,424,173 | B1 * | 9/2019 | Bien | E02B 3/20 |
| 10,443,814 | B2 | 10/2019 | Zhang et al. | |
| 10,720,031 | B1 * | 7/2020 | Cronmiller | F21S 8/00 |
| 2006/0132323 | A1 * | 6/2006 | Grady, Jr. | G08B 5/36<br>340/815.45 |
| 2010/0244748 | A1 * | 9/2010 | Haab | H05B 47/155<br>315/313 |

* cited by examiner

LED LUMINAIRE ASSEMBLY WITH UPLIGHT AND SIDELIGHT LENS

CROSS-REFERENCE TO RELATED APPLICATIONS

This patent application claims the benefit of U.S. Provisional Patent Application No. 63/124,342, filed on Dec. 11, 2020, titled "HARSH AND HAZARDOUS LOCATION LIGHT EMITTING DIODE (LED) LUMINAIRE ASSEMBLY AND METHOD WITH UPLIGHT AND SIDELIGHT LENS," the entire contents and disclosures of which are hereby incorporated herein by reference in their entirety.

BACKGROUND OF THE DISCLOSURE

The field of the disclosure relates generally to industrial luminaire assemblies for harsh and hazardous environments, and more particularly to light-emitting diode (LED) luminaire and lens assemblies for harsh and hazardous environments providing sidelight and uplight and manufacturing methods therefor.

To address the shortcomings of incandescent bulbs in traditional lighting figures, more energy-efficient and longer lasting sources of illumination in the form of LEDs are highly desired. LED Luminaires are very efficient, both in Lumens/Watt and in targeting light towards the work plane. This high efficiency means that very little if any light is lost to the side and above the luminaire such that the ceiling and top of the room walls are significantly darker than the working plane. In certain installations in harsh and hazardous environments, however, some illumination of the ceiling above the luminaire and portions of the room walls near the ceiling is desired in order to view pipe racks, other machinery, or surroundings. Improvements are therefore desired.

BRIEF DESCRIPTION

In one aspect, a light-emitting diode (LED) luminaire assembly is disclosed. The assembly includes an LED assembly configured to emit light and a lens coupled to the LED assembly and forming a concavity facing the LED assembly. The lens includes a side wall forming an opening sized to receive at least part of the LED assembly and a bottom opposite the opening and coupled to the side wall. The side wall further includes one or more prisms positioned proximate the bottom and configured to direct light emitted from the LED assembly away from the bottom In another aspect, a lens for a light-emitting diode (LED) assembly is disclosed. The assembly includes a side wall forming an opening sized to receive at least part of the LED assembly and a bottom opposite the opening and coupled to the side wall. The side wall and the bottom form a concavity facing the opening, and the side wall further includes one or more prisms positioned proximate the bottom and configured to direct light emitted through the opening away from the bottom In yet another aspect, a method of fabricating a light-emitting diode (LED) luminaire assembly is disclosed. The method includes providing an LED assembly configured to emit light and a lens. The lens includes a side wall forming an opening sized to receive at least part of the LED assembly and a bottom opposite the opening and coupled to the side wall. The side wall further includes one or more prisms formed proximate the bottom and configured to direct light emitted through the opening away from the bottom, the lens forming a concavity. The method further includes coupling the LED assembly with the lens by facing the concavity of the lens toward the LED assembly such that light emitted from the LED assembly is directed toward the bottom of the lens.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Non-limiting and non-exhaustive embodiments are described with reference to the following Figures, wherein like reference numerals refer to like parts throughout the various drawings unless otherwise specified.

DETAILED DESCRIPTION

Figure 1:
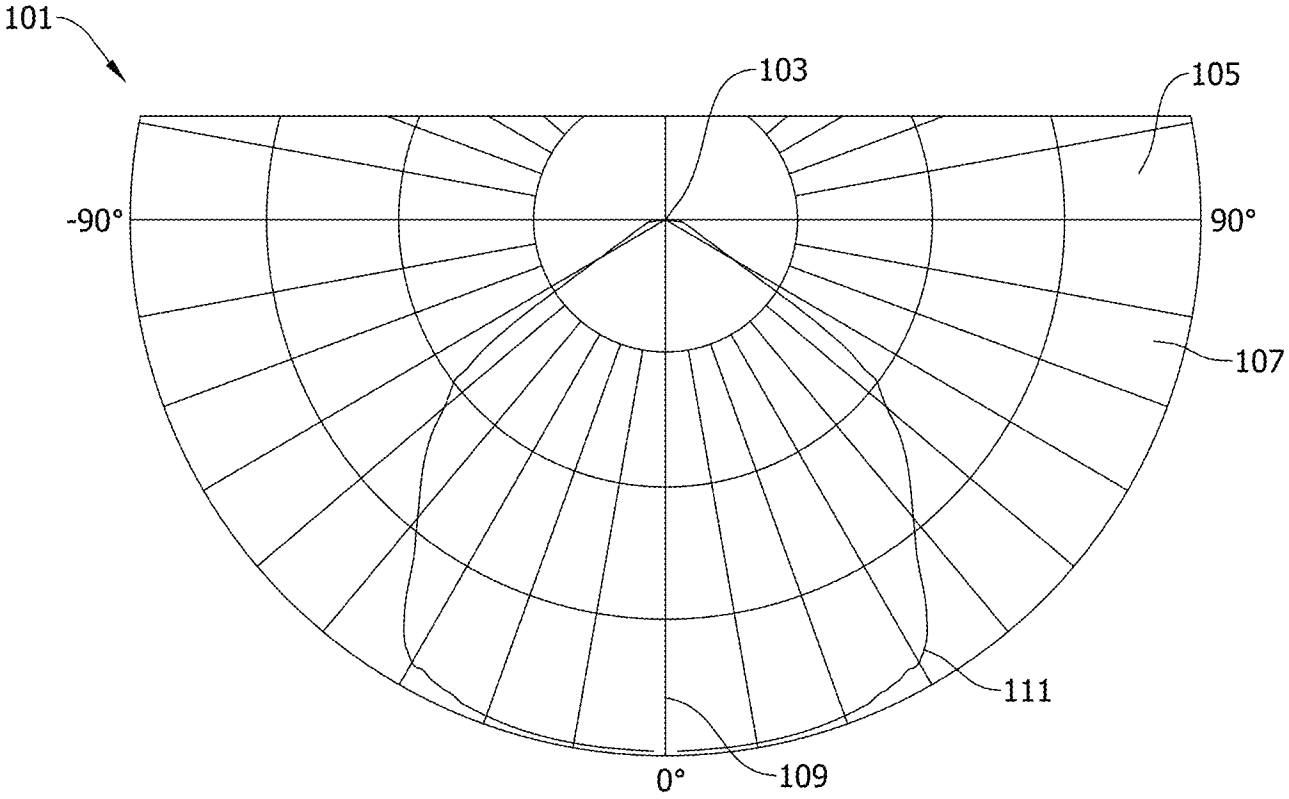
FIG. 1 PRIOR ART
FIG. 1 is a polar plot of a beam pattern of a known light-emitting diode (LED) luminaire assembly.

Industrial light-emitting diode (LED) luminaire assemblies and methods are disclosed herein that accordingly provide a desirable emission of sidelight and uplight for installation in harsh and hazardous locations. Sub-optimal illumination of existing LED assemblies for industrial use which undesirably lack sidelight and uplight desired for certain installations is avoided and substantial benefits are realized. Method aspects will be in part apparent and in part explicitly discussed in the following description.

Various types of lighting fixtures utilizing LEDs have been developed for numerous types of commercial and industrial environments. More specifically, LED light fixtures have been developed for lighting tasks in harsh and hazardous environments, such as being designed to be explosion-protected. Such lighting fixtures are constructed to be shock-resistant and vibration resistant with no filament or glass to break, for immediate start with instant full illumination, no lifetime reduction due to switching cycles, and reduced disposal costs.

Luminaire assemblies that operate within hazardous environments present a risk of explosion via ignition of a surrounding gas or vapor dusts, fibers, or flyings. Such hazardous environments may arise, for example only, in petroleum refineries, petrochemical plants, grain silos, waste water and/or treatment facilities among other industrial facilities, wherein volatile conditions are produced in the ambient environment and present a heightened risk of fire or explosion. An occasional or continuous presence of airborne ignitable gas, ignitable vapors or ignitable dust, or otherwise flammable substances presents substantial concerns regarding safe and reliable operation of such facilities overall, including, but not limited to, safe operation of the lighting fixtures within predetermined temperature limits that, if exceeded, could produce ignition sources for possible fire or explosion. As such, a number of standards have been promulgated relating to electrical product use in explosive environments to improve safety in hazardous locations in view of an assessed probability of explosion or fire risk.

For example, Underwriter's Laboratories ("UL") standard UL 1203 sets forth Explosion-Proof and Dust-Ignition-Proof Electrical Equipment criteria for hazardous locations. Electrical equipment manufacturers may receive UL certification of compliance with the applicable rating standards for hazardous locations, and UL certification is an important aspect of a manufacturer's ability to successfully bring products to market in North America or any other market accepting of UL standard 1203.

The National Electric Code (NEC) generally classifies hazardous locations by class and division. Class 1 locations are those in which flammable vapors and gases may be present. Class II locations are those in which combustible dust may be found. Class III locations are those which are hazardous because of the presence of easily ignitable fibers or flyings. Considering Class 1, Division 1 covers locations where flammable gases or vapors may exist under normal operating conditions, under frequent repair or maintenance operations, or where breakdown or faulty operation of process equipment might also cause simultaneous failure of electrical equipment. Division 1 presents a greater risk of explosion than, for example, Division 2 where flammable gases or vapors are normally handled either in a closed system, confined within suitable enclosures, or are normally prevented by positive mechanical ventilation.

The International Electrotechnical Commission (IEC) likewise categorizes hazardous locations into Class I, Zone 0, 1, or 2 representing locations in which flammable gases or vapors are or may be airborne in an amount sufficient to produce explosive or ignitable mixtures. As defined in the IEC, a Class I, Zone 0 location is a location in which ignitable concentrations of flammable gases or vapors are present continuously or for long periods of time. A Class I, Zone 1 location is a location in which ignitable concentrations of flammable gases or vapors are likely to exist because of repair or maintenance operations or because of leakage or possible release of ignitable concentrations of flammable gases or vapors, or is a location that is adjacent to a Class I, Zone 0 location from which ignitable concentrations of vapors could be communicated.

While expressed a bit differently, IEC Zone 1 and NEC Division 2, in practice, generally converge to common locations in the assessment of hazardous environments. In view of modern environmental regulation and the concentrated nature of Division 1 and Zone 0 applications, any lighting fixtures installed in such hazardous locations must reliably operate at a safe temperature with respect to the surrounding atmosphere. As such, conventional LED lighting fixtures for hazardous locations include more extensive heat sink features for dissipating heat than other types of lighting fixtures, and the heat sinks may considerably complicate the lighting fixture assembly and also render the cost of hazardous location LED lighting fixtures undesirably high.

In addition to hazardous locations discussed above, so-called harsh locations also require specific focus in the design of light fixtures used therewith. Harsh locations may entail corrosive elements and the like in the atmosphere that are not necessarily explosive and/or are subject to temperature cycling, pressure cycling, shock and/or mechanical vibration forces that are typically not present in non-harsh operating environments. Of course, some locations in which LED lighting fixtures are desirably employed are both harsh and hazardous by nature, and are therefore heavy duty fixtures designed to withstand various operating conditions that typical lighting features for other uses could not withstand.

An LED luminaire assembly is more efficient than a high intensity discharge (HID) luminaire assembly or incandescent light both in Lumens/Watt and in targeting light towards the work plane with extreme efficiency such that very little if any light is emitted to the side and above the luminaire assembly. In contrast, legacy technologies such as HID or incandescent lights may desirably emit light in all directions, allowing there to be a significant portion of light that is directed both to the side and above the luminaire. In certain types of known industrial LED luminaire assemblies, negligible sidelight or uplight is emitted from the luminaire assembly, creating an undesirable visual effect that is sometimes referred to as a cave effect in certain installations such as harsh and/or hazardous locations wherein sidelight and/or uplight is desirable to illuminate some portion of the ceiling above the luminaire assembly and wall surfaces. Such sidelight and uplight may beneficially and desirably allow workers to more naturally view pipe racks, machinery, or other surroundings that would otherwise be obscured by cave effects to perform needed tasks and to take appropriate measures to ensure safety in the harsh or hazardous environment.

FIG. 1 shows a polar plot 101 of a beam pattern 111 of a known industrial LED assembly 103 that is suited for harsh and/or hazardous location use. The LED assembly 103 is suspended from the ceiling at the center of the plot and faces the floor located at a distance below and extending generally perpendicularly to the 0° position in the plot. Wall surfaces may also be located at some distance from the LED assembly 103 and extend generally perpendicular to the plus or minus 90° positions in the plot in a typical installation. An uplight zone 105 is a zone above the −90°/90° positions, where a line connecting a location in the uplight zone 105 with the LED assembly 103 forms an angle greater than 90° or less than −90°, with a line 109 starting from the center and extending normal to the floor. As described herein, uplight is light emitted from the LED assembly 103 that is in the uplight zone 105. Sidelight is light emitted from the LED assembly 103 that is in the plus or minus 60°-90° zone, which may be referred to as a sidelight zone 107. As shown by the beam pattern 111, the LED assembly 103 emits negligible sidelight and no uplight, and therefore generates a cave effect wherein the ceiling and walls are generally not illuminated and are therefore dark while the area directly beneath the LED assembly 103 is brightly illuminated. In industrial installations the cave effect can negatively impact an ability of workers to see or inspect, for example, overhead pipes, machinery or equipment located near the walls, or other items of interest to workers in an industrial facility.

Inventive LED luminaire assemblies disclosed herein are advantageously configured to increase sidelight and uplight in the emitted light from the LED luminaire assembly. The cave effect for LED luminaire assemblies is substantially reduced, if not eliminated, such that the light emitted from the LED luminaire assembly allows workers to see the surrounding of the work area, besides the work area itself. While described in the context of industrial environments that may be harsh and/or hazardous by nature, at least some of the benefits of the LED luminaire assemblies of the invention may likewise accrue to environments that are not necessarily harsh or hazardous. The description in these aspects is provided for the sake of illustration rather than limitation.

Figure 2A:
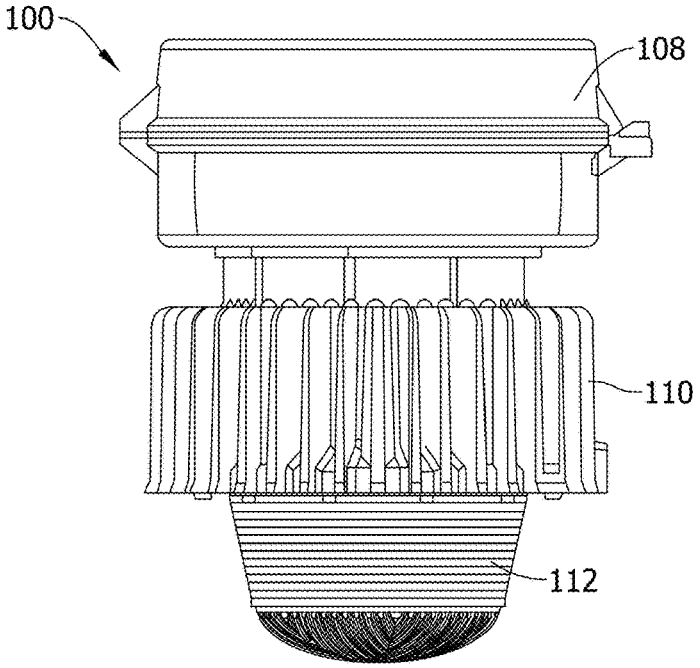
FIG. 2A is a front view of an exemplary luminaire assembly.
Figure 2B:
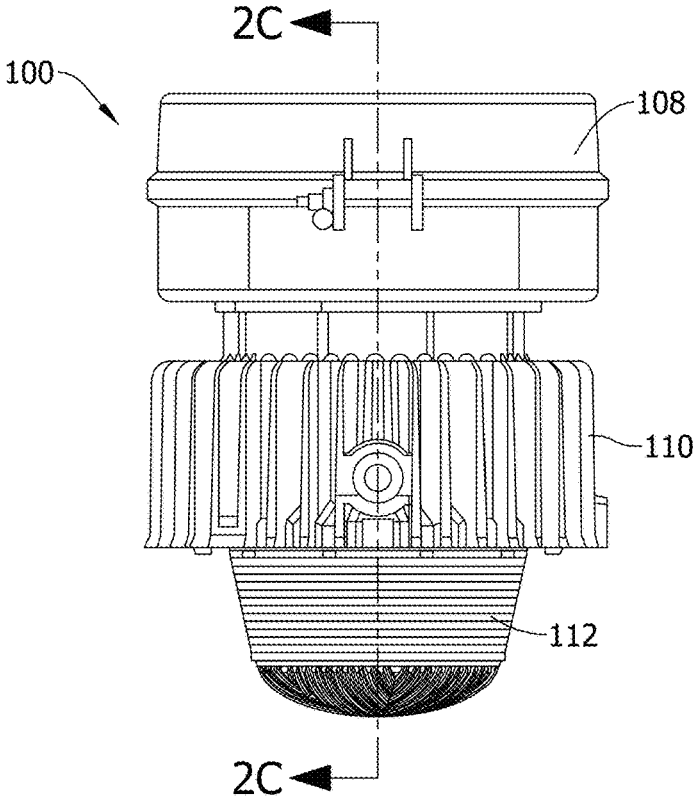
FIG. 2B is a side view of the luminaire assembly shown in FIG. 2A.
Figure 2C:
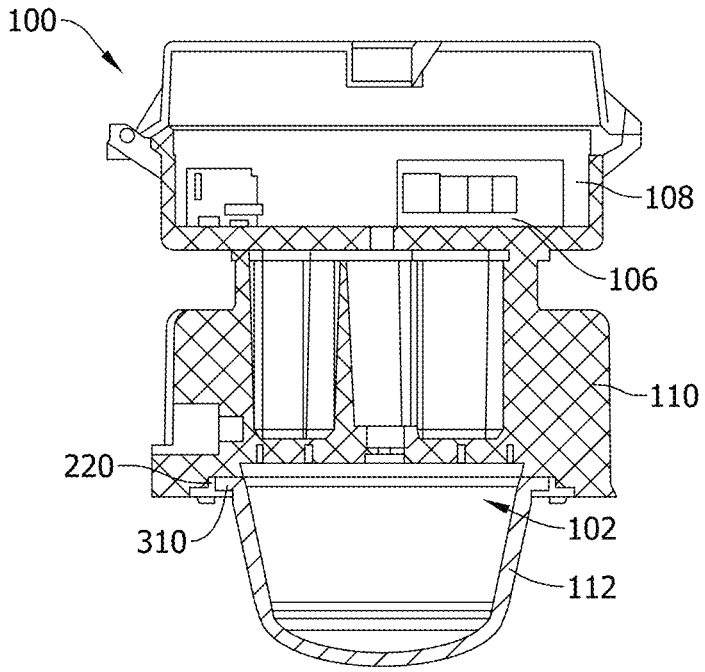
FIG. 2C is a cross-sectional view of the luminaire assembly shown in FIG. 2A along line 2C-2C in FIG. 2B.

FIGS. 2A-2C are views of an exemplary LED luminaire assembly 100. FIGS. 2A and 2B are a front view and a side view of the LED luminaire assembly 100, respectively. FIG. 2C is a cross-section view along line 2C-2C in FIG. 2B of the LED luminaire assembly 100. The LED luminaire assembly 100 includes an LED assembly 102 that has one or more LEDs (not shown). The LED luminaire assembly 100 may further include a driver 106 and a driver housing 108. The driver 106 is enclosed inside the driver housing 108 and powers the LEDs of the LED assembly 102 in a known manner. The LED luminaire assembly 100 may also include a heat sink 110 for dissipating heat generated by the LED assembly and/or the driver 106. The LED luminaire assembly 100 further includes a lens 112. The lens 112 is configured to divert light emitted from the LED assembly 102 to the sides of the LED luminaire assembly 100 and above the LED luminaire assembly 100. In contemplated embodiments the assembly 100 is fabricated and assembled to meet the requirements of harsh and/or hazardous locations as described above.

In operation, the driver 106 provides electricity to the LED assembly 102. As a result, the LED assembly 102 emits light toward the lens 112. Part of the light emitted from the LED assembly 102 is redirected by the lens 112 to the sides of the LED luminaire assembly 100 and above the LED luminaire assembly 100. The light emitted from the LED luminaire assembly 100 therefore includes sidelight, which is from the sides of the LED luminaire assembly 100, and uplight, which is above the LED luminaire assembly 100. As such, and unlike the polar plot shown in FIG. 1, the LED luminaire assembly 100 emits light in the uplight zone 105 and the sidelight zone 107 to effectively reduce or eliminate the cave effect and avoid associated drawbacks for installation in a harsh or hazardous environment.

Figure 3A:
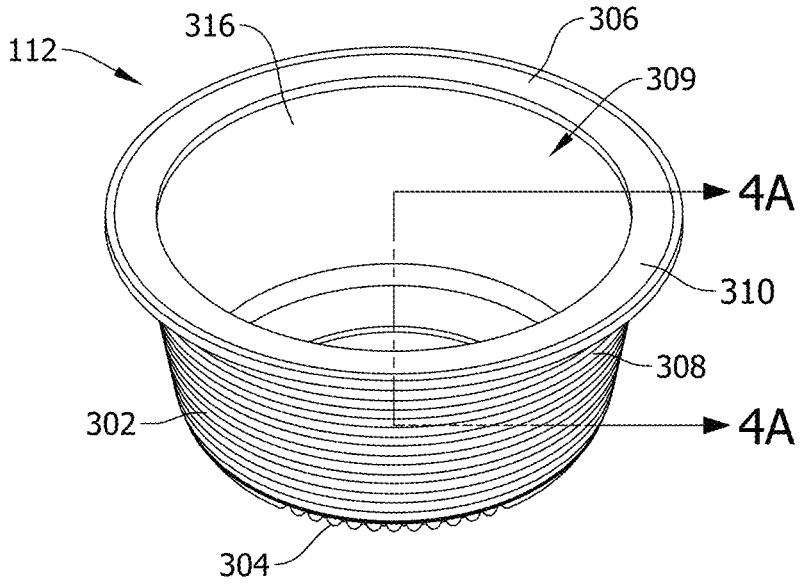
FIG. 3A is a top perspective view of an exemplary lens for the luminaire assembly shown in FIG. 2A.
Figure 3B:
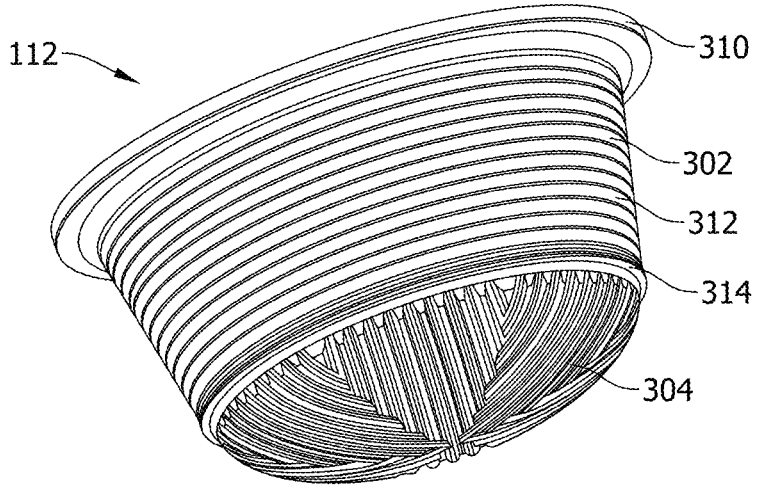
FIG. 3B is a bottom perspective view of the lens shown in FIG. 3A.
Figure 3C:
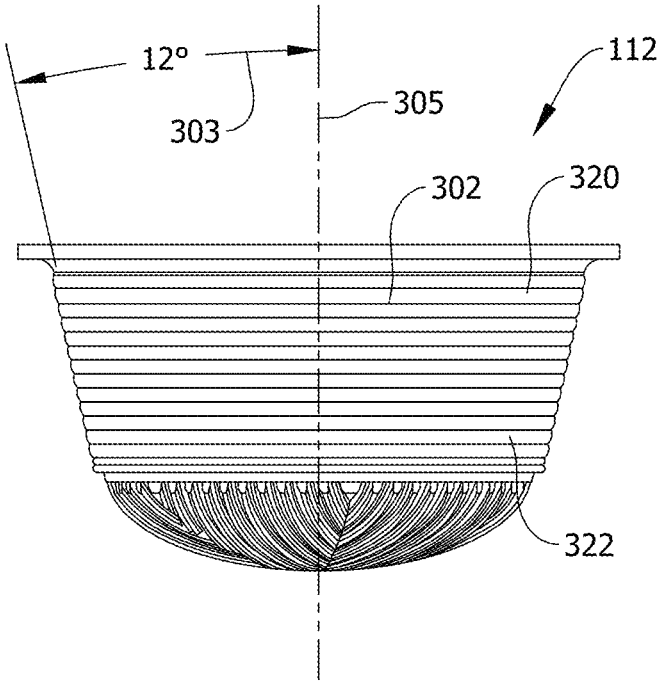
FIG. 3C is a side view of the lens shown in FIG. 3A.

FIGS. 3A-3C show an exemplary embodiment of the lens 112. FIGS. 3A and 3B are a top perspective view and a bottom perspective view of the lens 112, respectively. FIG. 3C is a side view of the lens 112. The lens 112 is fabricated from a translucent or transparent material, such as glass or plastic. The lens 112 includes a side wall 302 and a bottom 304 coupled to the side wall 302.

In the exemplary embodiment, the side wall 302 forms an opening 306 that is opposite the bottom 304. The opening 306 is sized to receive at least part of the LED assembly 102 such that when the lens 112 is installed onto the LED luminaire assembly 100, the lens 112 forms a dome over least part of the LED assembly 102. The side wall 302 is slanted outward at an end 308 proximate the opening 306 and forms an upside-down flare, which has an angle 303 with respect to a vertical line 305 (FIG. 3C). An exemplary angle 303 is 12° although greater or lesser angles are possible in another embodiment. The dimension of the upper portion 320 of the lens 112 is greater than the dimension of the lower portion 322 of the lens 112. The slanted side wall 302 refracts and diffuses light emitted from the LED assembly 102 that hits the slanted side wall 302, providing sidelight. The side wall 302 and the bottom 304 form a concavity 309 facing the opening. The end 308 of the side wall 302 may extend sideways away from the center of the lens 112 and form into a flange 310. The flange 310 is used to couple the lens 112 to the LED luminaire assembly 100 by the flange 310 being inserted into a groove 220 in the LED luminaire assembly 100 (see FIG. 2C).

In the exemplary embodiment, the side wall 302 further includes lenticular rings 312 positioned on an exterior surface of the side wall 302. The interior surface 316 of the lens 112 is smooth, such as being devoid of projections or recesses. The side wall 302 also includes one or more prisms 314 at the portion of the side wall that merges with the bottom 304. The transverse cross section of the side wall is circular in the depicted example, and may take other shapes, such as rectangular, oval, or polygonal.

In the exemplary embodiment, the lens 112 is manufactured as one piece. The lens 112 may be manufactured by molding.

Figure 4A:
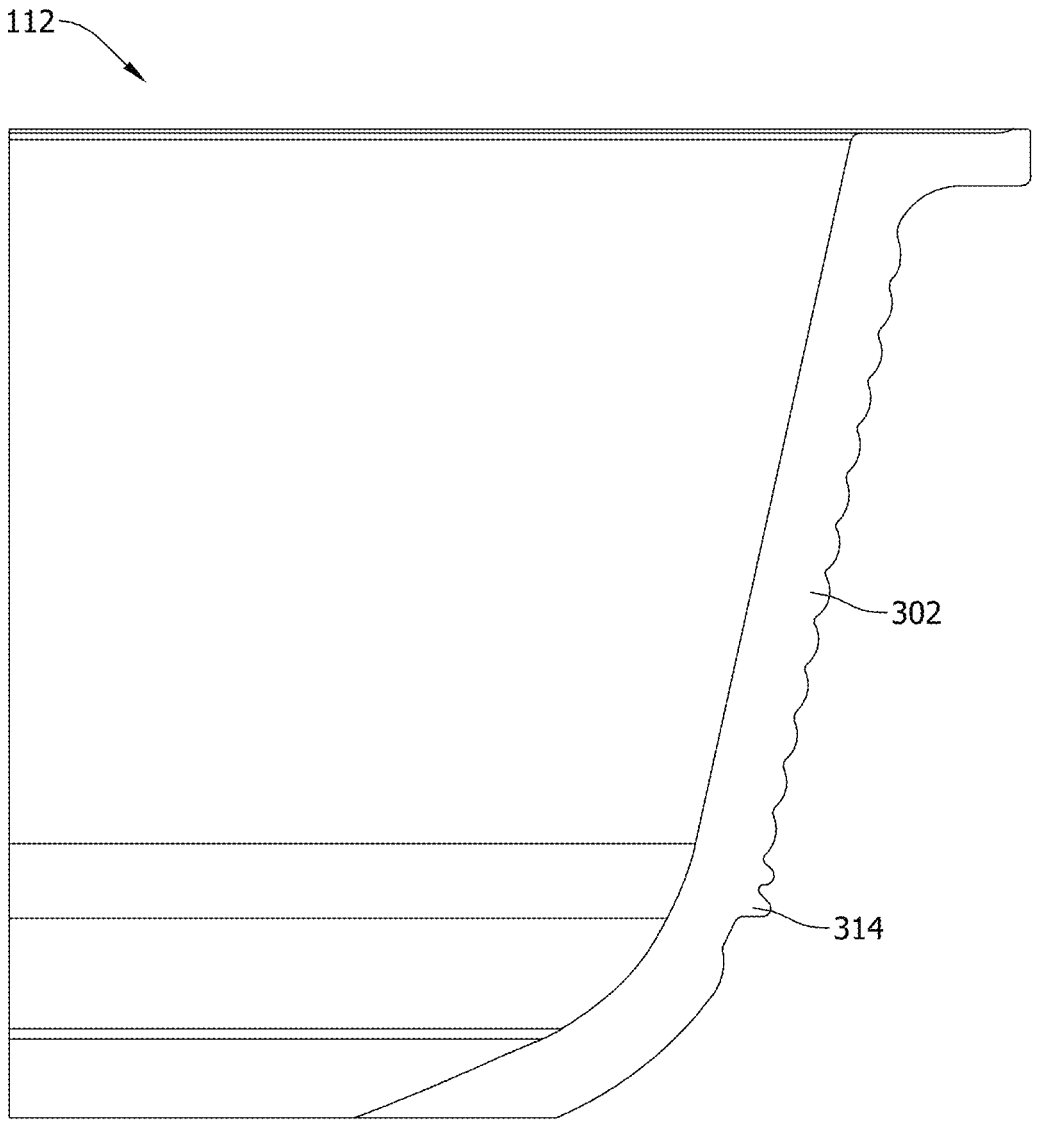
FIG. 4A is an enlarged cross-sectional view along line 4A-4A of part of the lens shown in FIG. 3A.
Figure 4B:
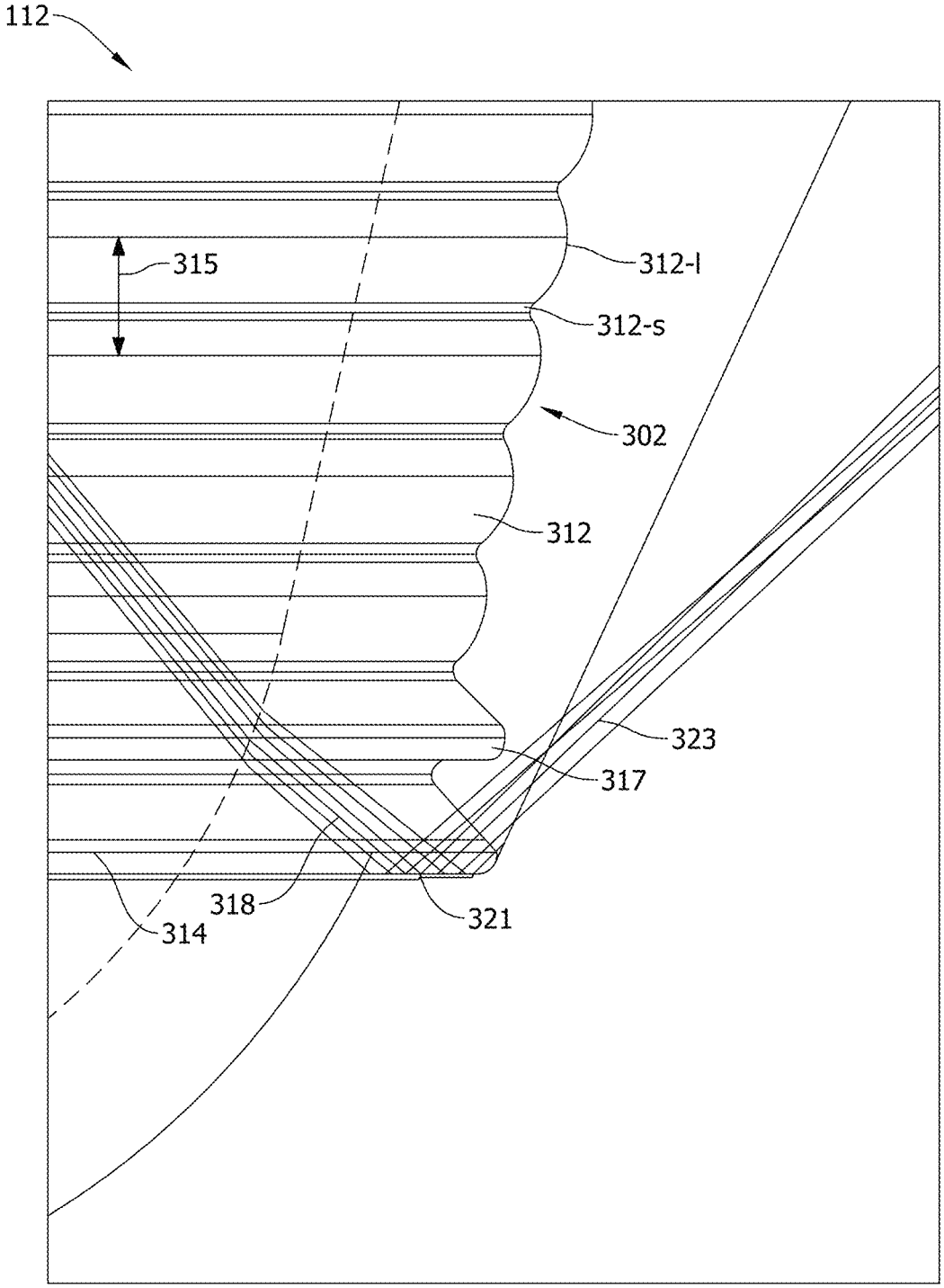
FIG. 4B is a schematic diagram of light traveling through the lens shown in FIG. 3A.

FIG. 4A is an enlarged cross-sectional view along line 4A-4A in FIG. 3A of part of the lens 112, showing the lenticular rings 312 and the prisms 314. FIG. 4B is a schematic diagram of light traveling through the prism 314 of the lens 112. In the exemplary embodiment, the lenticular rings 312 are positioned on an exterior surface of the side wall 302 and project from the exterior surface. The lenticular rings 312 are convex. The lenticular rings 312 may be parallel to each other. In one example, the lenticular rings 312 are generally horizontal when the lens 112 is placed upright by itself. In some embodiments, the neighboring or adjacent lenticular rings 312-1, **312-*s* have different radii of curvature. For example, a lenticular ring 312-1 has a radius of curvature of approximately 3.2 mm (0.125 inches (in.)), and a lenticular ring 312-*s* has a radius of curvature of approximately 0.5 mm (0.02 in.) (see FIG. 3C). Neighboring lenticular rings having different radii of curvature further diffuse the light. In one example, the distance 315 between two adjacent lenticular rings 312-1 that have larger radii is approximately 4.3 mm (0.17 in.) (see FIG. 3**C).

In the exemplary embodiment, the prisms 314 are convex. The prisms 314 are positioned proximate the junction between the bottom 304 and the side wall 302. A cross section of the prism is approximately triangular. An exemplary angle in the triangular cross section is 48° (see FIG. 3C). An edge 317 of the prism 314 may be a curved surface that is curved along a direction perpendicular to the edge (FIG. 4B). In other words, two surfaces of the prism 314 intersect and form a rounded edge, instead of a sharp edge. A rounded edge 317 helps diffuse light that hits the edge 317. An exemplary radius of curvature of the edge 317 is 0.8 mm (0.03 in.) (see FIG. 3C). The prism 314 in one example is a total internal reflection (TIR) prism, where light is completely reflected when the light travels from the medium of the lens 112 to air. For example, light 318 emitted from the LED assembly 102 travels into the side wall 302 and is refracted by the side wall 302. When the light 318 further travels to the interface 321 between the medium of the lens 112 and air, the incidence angle of the light 318 is greater than a critical angle for the medium of the lens 112 and air, and the light 318 is completely reflected by the interface 321. The reflected light 323 travels upwards, providing uplight for the LED luminaire assembly 100. The lens 112 shown in FIGS. 3B-4B includes two prisms. The number of prisms is determined by the desired amount of uplight and/or sidelight, depending on the design of the prism 314. To achieve a desired amount of sidelight, the radius and spacing of the lenticular rings 312 may also be adjusted. An exemplary distance between two adjacent prisms 314 is 2.2 mm (0.09 in.) (see FIG. 3C).

Figure 5:
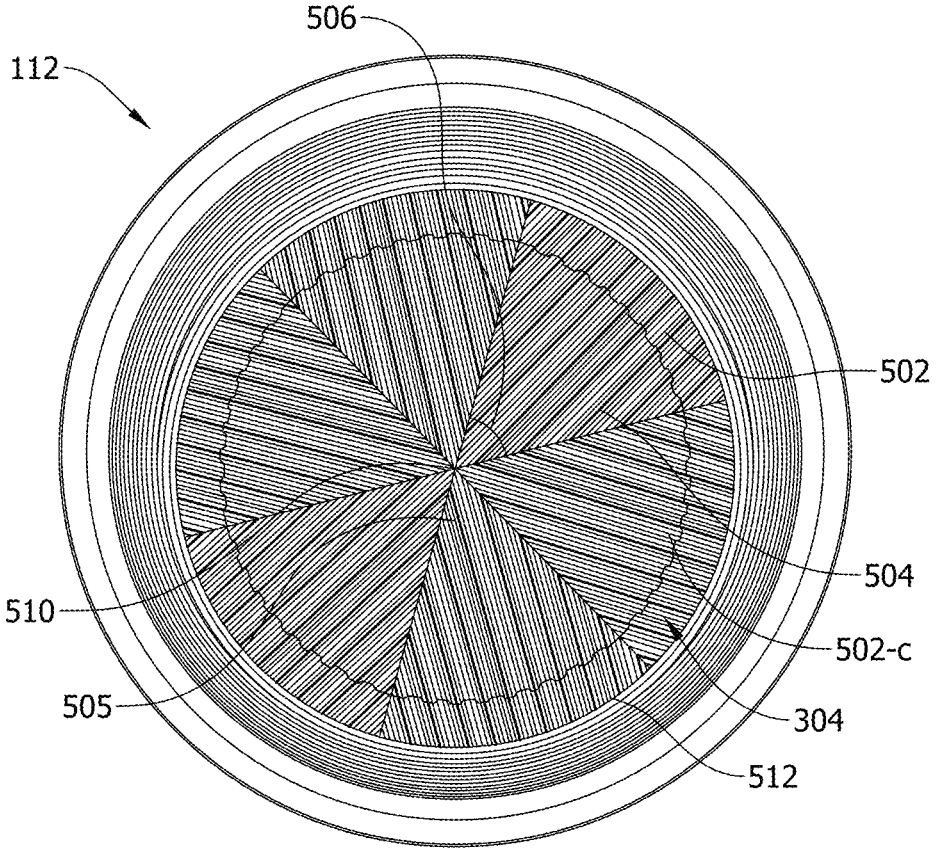
FIG. 5 is a bottom view of the lens shown in FIG. 3A.

FIG. 5 is a bottom view of the lens 112. In the exemplary embodiment, the bottom 304 is convex, and may form into a spherical dome. The bottom 304 may include lenticular ribs 502. The lenticular ribs 502 are positioned along an exterior surface of the bottom 304. The lenticular ribs 502 diffuse light and eliminate hot spots. The lenticular ribs 502 also strengthen the structure of the lens 112 and reduce stress during potential impacts. The lenticular ribs 502 may be formed and grouped into a plurality of sections 504. The sections may divide the bottom into equal sections 504, with the sections 504 having equal central angles 506. The lenticular ribs 502 in one section 504 may be parallel to each other. The radii of curvature of the lenticular ribs in one section may vary. The spacing between neighboring lenticular ribs may also vary. The various radii and spacing help diffuse the light emitted from the LED assembly 102. The center lenticular ribs or transverse ribs 502-*c* of each section 504 converge toward a point 510 that is located in a center area 505 of the bottom 304 surrounding the apex of the bottom 304. In one example, the point 510 is the apex of the bottom 304. The center lenticular ribs 502-*c* may split the section 504 into two subsections having equal central angle 506. The bottom 304 may be in other shapes, such as polyhedral. The base 512 of the bottom 304, where the bottom 304 and the side wall 302 intersect, is spherical in the depicted embodiment. The base 512 may be in other shapes such as polygonal. The lenticular ribs may be in shapes or form into patterns other than depicted. Variations and adaptations in shape, geometry, curvature, dimensions, and angular position of the features described is possible to realize at least some of the benefits described.

Figure 6B:
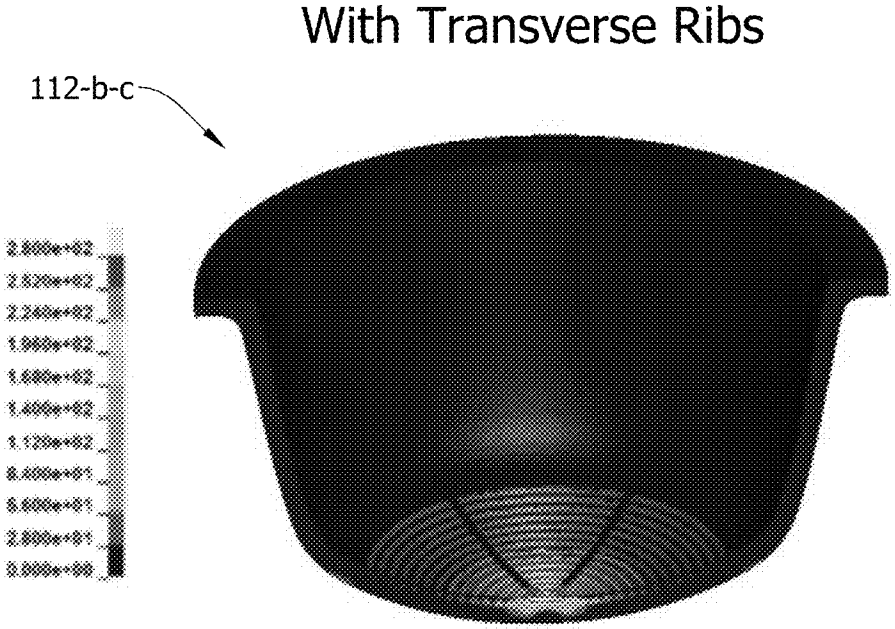
FIG. 6B shows simulation results of an impact test on a lens having bullseye rings and lenticular ribs at the bottom of the lens.
Figure 6A:
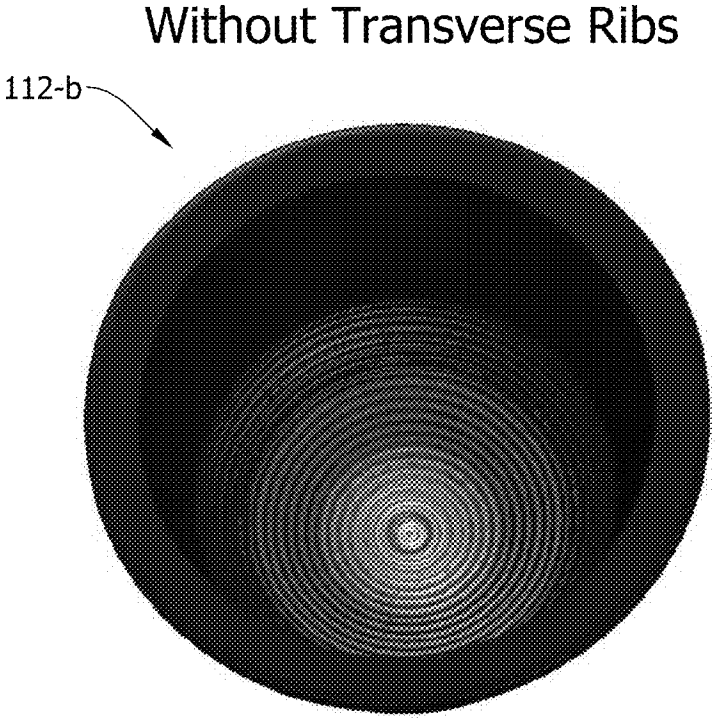
FIG. 6A shows simulation results of an impact test on a lens having bullseye rings at the bottom of the lens.

FIGS. 6A and 6B show simulation results of stress test of a lens 112-*b* having bullseye lenticular ribs and a lens 112-*b*-*c* having bullseye lenticular ribs and transverse ribs 502-*c*. The stress on the lens is simulated when a smooth steel sphere is dropped on the lens 112-*b*, 112-*b*-*c* from a fixed distance. The maximum stress for the lens 112-*b*-*c* is approximately 15% less than the maximum stress for the lens 112-*b*. Compared to bullseye lenticular ribs, transverse ribs 502-*c* reduce the stress on the lens from impact, and reduce the likelihood of the lens being broken from the impact.

Figure 7:
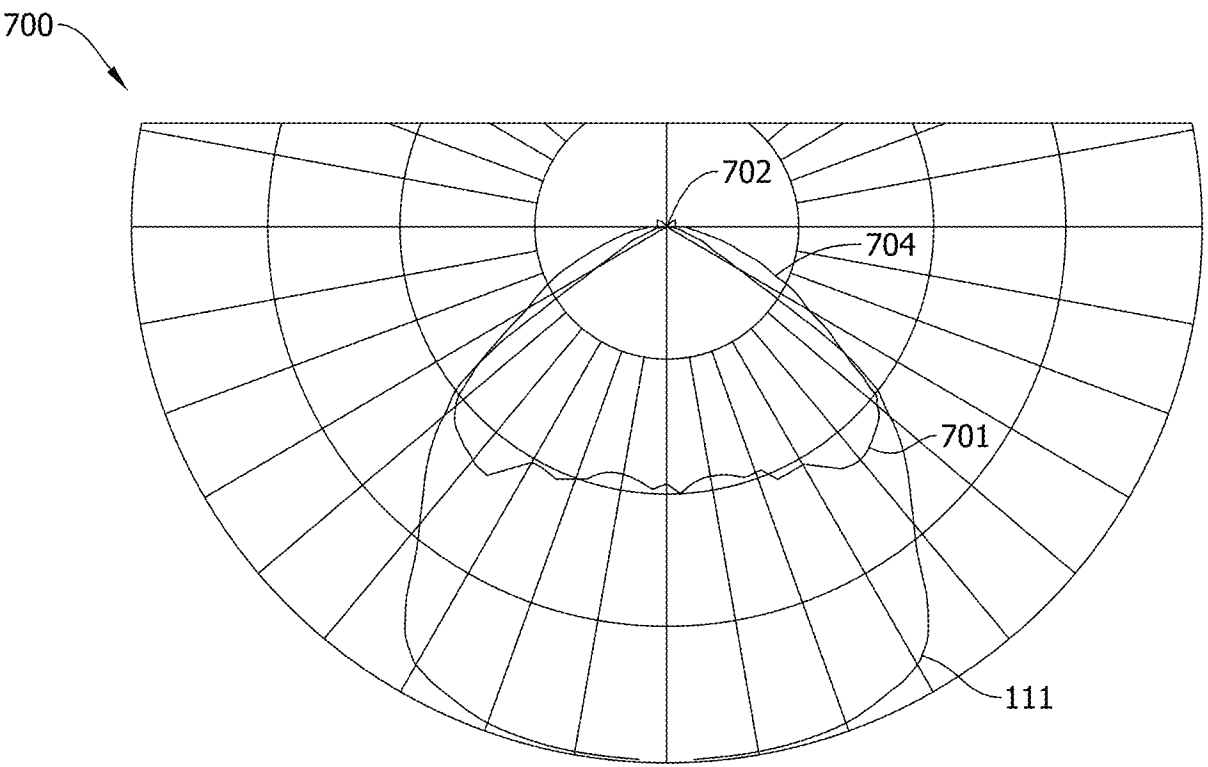
FIG. 7 is a polar plot of beam diagrams of the known luminaire assembly for FIG. 1 and the luminaire assembly shown in FIG. 2A.

FIG. 7 is a polar plot 700 including a comparison of the beam pattern 111 of the known luminaire assembly for FIG. 1 and a beam pattern 701 of a LED luminaire assembly 100 as described herein. The amount of uplight 702 is approximately 5% and the amount of sidelight 704 is approximately 18%, which is within desired ranges of approximately 12% to 20% for sidelight and approximately 5% for uplight. More optimal lighting is therefore produced for harsh and hazardous locations to improve situational awareness and safety of workers that would otherwise be impeded by the cave effect produced by conventional LED luminaire assemblies.

Figure 8:
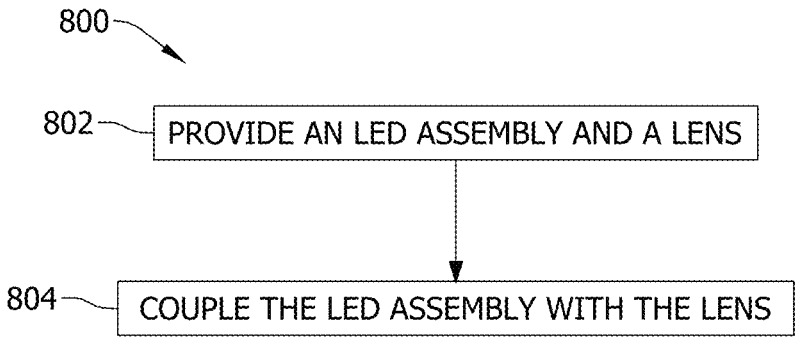
FIG. 8 is a flow chart of an exemplary method of fabricating the luminaire assembly shown in FIGS. 2A-6B.

FIG. 8 is a flowchart of an exemplary method 800 of fabricating an LED luminaire assembly. The method 800 includes providing 802 an LED assembly configured to emit light and a lens. The lens includes a side wall and a bottom. The side wall of the lens forms an opening sized to receive at least part of the LED assembly. The bottom is positioned opposite the opening and coupled to the side surface. The side wall further includes one or more prisms positioned proximate the bottom and configured to direct light emitted through the opening away from the bottom, the lens forming a concavity. The method 800 also includes coupling 804 the LED assembly with the lens by facing the concavity of the lens toward the LED assembly such that light emitted from the LED assembly is directed toward the bottom of the lens.

At least one technical effect of the LED luminaire assemblies and methods described herein includes (a) prisms redirecting and providing uplight and sidelight emissions of LED light; (b) lenticular rings positioned on exterior of a lens, which diffuse LED light and provide sidelight; (c) lenticular ribs positioned on the bottom of a lens, which diffuse LED light and strengthen the structure of the lens.

The benefits and advantages of the inventive concepts are now believed to have been amply illustrated in relation to the exemplary embodiments disclosed.

An embodiment of an LED luminaire assembly is provided. The LED luminaire assembly includes an LED assembly configured to emit light and a lens coupled to the LED assembly and forming a concavity facing the LED assembly. The lens includes a side wall forming an opening sized to receive at least part of the LED assembly and a bottom opposite the opening and coupled to the side wall. The side wall further includes one or more prisms positioned proximate the bottom and configured to direct the light emitted from the LED assembly away from the bottom.

Optionally, the one or more prisms are TIR prisms. An edge of the one or more prisms is a curved surface that is curved along a direction perpendicular to the edge. The side wall of the lens includes two prisms. The bottom of the lens further includes lenticular ribs positioned along an exterior surface of the bottom. At least some of the lenticular ribs converge toward a point in a center area of the bottom. The side wall of the lens further includes lenticular rings positioned on an exterior surface of the side wall and wrapping around the side wall, the lenticular rings configured to direct the light emitted from the LED assembly sideways and away from the luminaire assembly. Neighboring lenticular rings have different radii of curvature. The lens includes a smooth interior surface. The side wall is slanted outward at an end of the side wall proximate the opening and forms an upside-down flare. The luminaire assembly is configured to emit approximately 5% uplight. The luminaire assembly is configured to emit sidelight in a range from approximately 12% to approximately 20%.

An embodiment of a lens for a light-emitting diode (LED) assembly is disclosed. The lens includes a side wall forming an opening sized to receive at least part of the LED assembly and a bottom opposite the opening and coupled to the side wall. The side wall and the bottom form a concavity facing the opening, and the side wall further includes one or more prisms positioned proximate the bottom and configured to direct light emitted through the opening away from the bottom.

Optionally, the one or more prisms are TIR prisms. An edge of the one or more prisms is a curved surface that is curved along a direction perpendicular to the edge. The side wall includes two prisms. The bottom of the lens further includes lenticular ribs positioned along an exterior surface of the bottom, and at least some of the lenticular ribs converge toward a point in a center area of the bottom. The side wall of the lens further includes lenticular rings positioned on an exterior surface of the side wall and wrapping around the side wall, the lenticular rings configured to direct the light emitted from the LED assembly sideways and away from the lens, neighboring lenticular rings have different radii of curvature. The side wall is slanted outward at an end of the side wall proximate the opening and forms an upside-down flare.

An embodiment of a method of fabricating a light-emitting diode (LED) luminaire assembly is disclosed. The method includes providing an LED assembly configured to emit light and a lens. The lens includes a side wall forming an opening sized to receive at least part of the LED assembly and a bottom opposite the opening and coupled to the side wall. The side wall further includes one or more prisms formed proximate the bottom and configured to direct light emitted through the opening away from the bottom, the lens forming a concavity. The method also includes coupling the LED assembly with the lens by facing the concavity of the lens toward the LED assembly such that light emitted from the LED assembly is directed toward the bottom of the lens.

While exemplary embodiments of components, assemblies and systems are described, variations of the components, assemblies and systems are possible to achieve similar advantages and effects. Specifically, the shape and the geometry of the components and assemblies, and the relative locations of the components in the assembly, may be varied from that described and depicted without departing from inventive concepts described. Also, in certain embodiments, certain components in the assemblies described may be omitted to accommodate particular types of luminaire assemblies and/or lenses or the needs of particular installations, while still providing the needed performance and functionality.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A lens for a light-emitting diode (LED) assembly, comprising:

a side wall forming an opening sized to receive at least part of the LED assembly; and a bottom opposite the opening and coupled to the side wall, wherein the side wall and the bottom form a concavity facing the opening, and the side wall further comprises one or more prisms positioned proximate the bottom and configured to direct light emitted from the LED assembly toward a zone situated opposite to a main light emitting direction of the LED assembly.

2. The lens of claim 1, wherein the one or more prisms are total internal reflection (TIR) prisms.

3. The lens of claim 1, wherein two surfaces of each of the one or more prisms intersect and form a rounded edge.

4. The lens of claim 1, wherein the side wall comprises two prisms.

5. The lens of claim 1, wherein the bottom of the lens further comprises lenticular ribs positioned along an exterior surface of the bottom, and at least some of the lenticular ribs converge toward a point in a center area of the bottom.

6. The lens of claim 1, wherein the side wall of the lens further comprises lenticular rings positioned on an exterior surface of the side wall and wrapping around the side wall, the lenticular rings configured to direct light emitted from the LED assembly sideways and away from the lens, and wherein neighboring lenticular rings have different radii of curvature.

7. The lens of claim 1, wherein the side wall is slanted outward at an end of the side wall proximate the opening and forms an upside-down flare.

8. A light-emitting diode (LED) luminaire assembly, comprising:

an LED assembly configured to emit light; and a lens coupled to the LED assembly and forming a concavity facing the LED assembly, the lens comprising:

a side wall forming an opening sized to receive at least part of the LED assembly; and a bottom opposite the opening and coupled to the side wall, wherein the side wall further comprises one or more prisms positioned proximate the bottom and configured to direct light emitted from the LED assembly toward a zone situated opposite to a main light emitting direction of the LED assembly.

9. The luminaire assembly of claim 8, wherein the one or more prisms are total internal reflection (TIR) prisms.

10. The luminaire assembly of claim 8, wherein two surfaces of each of the one or more prisms intersect and form a rounded edge.

11. The luminaire assembly of claim 8, wherein the side wall of the lens comprises two prisms.

12. The luminaire assembly of claim 8, wherein the lens comprises a smooth interior surface.

13. The luminaire assembly of claim 8, wherein the side wall is slanted outward at an end of the side wall proximate the opening and forms an upside-down flare.

14. The luminaire assembly of claim 8, wherein the luminaire assembly is configured to emit at least 5% of the total light output as uplight.

15. The luminaire assembly of claim 8, wherein the luminaire assembly is configured to emit between 12% and 20% of the total light output as sidelight.

16. The luminaire assembly of claim 8, wherein the bottom of the lens further comprises lenticular ribs positioned along an exterior surface of the bottom.

17. The luminaire assembly of claim 16, wherein at least some of the lenticular ribs converge toward a point in a center area of the bottom.

18. The luminaire assembly of claim 8, wherein the side wall of the lens further comprises lenticular rings positioned on an exterior surface of the side wall and wrapping around the side wall, the lenticular rings configured to direct the light emitted from the LED assembly sideways and away from the luminaire assembly.

19. The luminaire assembly of claim 18, wherein neighboring lenticular rings have different radii of curvature.

20. A method of fabricating a light-emitting diode (LED) luminaire assembly, including:

providing an LED assembly configured to emit light and a lens, the lens including:

a side wall forming an opening sized to receive at least part of the LED assembly; and a bottom opposite the opening and coupled to the side wall, wherein the side wall further includes one or more prisms formed proximate the bottom and configured to direct light emitted through the opening away from the bottom, the lens forming a concavity; and coupling the LED assembly with the lens by facing the concavity of the lens toward the LED assembly such that a main direction of light emitted from the LED assembly is directed toward the bottom of the lens.

* * * * *